US006327877B1

(12) United States Patent
Zorini

(10) Patent No.: US 6,327,877 B1
(45) Date of Patent: Dec. 11, 2001

(54) DEVICE AND METHOD FOR OBTAINING FESTOONS ON A CROCHET MACHINE FOR WRAP WEAVING

(76) Inventor: Luigi Omodeo Zorini, Via Enrico Fermi, 5-27024 Cilavegna (Pavia) (IT)

( * ) Notice: Subject to any disclaimer, the term of this patent is extended or adjusted under 35 U.S.C. 154(b) by 0 days.

(21) Appl. No.: 09/130,798

(22) Filed: Aug. 7, 1998

(30) Foreign Application Priority Data

Dec. 10, 1997 (IT) ..... MI97A2735

(51) Int. Cl.[7] ..... D04B 25/14
(52) U.S. Cl. ..... 66/85 R
(58) Field of Search ..... 66/85 R, 193

(56) References Cited

U.S. PATENT DOCUMENTS 4,034,579 * 7/1977 Tillon ..... 66/85 R
5,680,777 * 10/1997 Zorini ..... 66/84 A

FOREIGN PATENT DOCUMENTS 0 922 803 * 6/1999 (EP) .

* cited by examiner

*Primary Examiner*—Andy Falik
(74) *Attorney, Agent, or Firm*—Robert F. I. Conte; Lee, Mann, Smith, McWilliams, Sweeney & Ohlson

(57) ABSTRACT

A device for obtaining festoons mounted on crochet machines for warp weaving comprises a curling hook engaged on a respective hook-holder block, a first motor, a second motor and a programmable electronic regulating unit. The first motor is operatively engaged to the curling hook and the second motor is operatively engaged to the hook holder block. The electronic unit activates the second motor to translate the hook and activates the first motor to curl the woof thread engaged on the hook itself by rotating the latter. The electronic unit, the positioning of the hook in the ending position and the rotation of the hook according to the distance assumed with respect to the needles of the machine. The electronic unit controls in synchronism to the motors, also, a cop-holder bar to produce a festoon having twisted threads of variable length.

14 Claims, 2 Drawing Sheets

DEVICE AND METHOD FOR OBTAINING FESTOONS ON A CROCHET MACHINE FOR WRAP WEAVING

BACKGROUND OF THE INVENTION

The present invention relates to a device for obtaining festoons on a crochet machine for warp weaving, said machine comprising one or more needles, at least one thread-guiding cop movable between a first position wherein the thread-guiding cop is positioned in proximity to the needles to engage operatively therewith at least one woof thread borne by the cop itself, and a second position wherein the cop is laterally displaced with respect to the needles to extend the woof thread away therefrom, said device comprising: at least one curling hook presenting a hooking portion set to engage the woof thread borne by the thread-guiding cop, said hook being able to revolve around an axis of rotation essentially perpendicular to the hooking portion itself; first control means to actuate the rotation of the curling hook.

According to the present invention, a method has also been devised to obtain festoons on a crochet machine for warp weaving, comprising the phases of: moving at least one thread-guiding cop from a first position wherein the thread-guiding cop is positioned in proximity to one or more needles to engage operatively therewith at least one woof thread borne by the cop itself, to a second position wherein the cop is laterally displaced with respect to the needles to extend the woof thread; winding the woof thread around a hooking portion of a curling hook located in correspondence with the second position of the thread-guiding cop making the cop pass around the hooking portion and bringing said cop back to the first position; rotating the curling hook by means of first control means to curl the wound woof thread and form a first twisted thread of predetermined length; translating the curling hook in rotation from a starting position, wherein the curling hook is positioned in correspondence with the thread-guiding cop in the second position, to an ending position, wherein the curling hook is positioned between the starting position and the needles; disengaging the twisted thread from the curling hook.

DESCRIPTION OF PRIOR ART

As is well known, the crochet machine for warp weaving essentially comprises a foundation presenting two lateral uprights between which extend a fixed front bar or front proper, a movable front bar, a thread-passer holder bar and a cop holder bar positioned parallel to each other.

The front bar presents on the upper part a plurality of grooves parallel to each other and perpendicular to the bar itself to receive in operative engagement respective needles rigidly connected to the movable front bar.

The movable front bar is actuated by respective control means to transmit to the needles a horizontal motion alternated between a back position wherein each needle has a hooked end in correspondence with the front bar and a forward position wherein said hooked end approaches a plurality of thread-passers.

The thread-passers lie side by side and positioned parallel to the needles on the thread-passer holder bar, the latter being able to be actuated by respective control means to move the thread-passers according to a circular trajectory around the direction of longitudinal advance of one or more needles.

The motions of the needles and of the thread-passers are synchronized in such a way that their co-operation on the warp threads gives rise to a plurality of parallel chains that progressively descend from the front bar. In most cases, the chains are also concatenated with warp threads borne by thread-guiding cops present on the cop holder bar.

In the machines intended for the production of festoons, each thread-guiding cop operates above the needles between a first position wherein said cop is positioned in proximity to the needles and a second position wherein the cop is positioned laterally displaced from the needles, in correspondence to a curling hook present on the machine.

When the cop is about to assume the second position, it is rotated slightly around the axis of development of the cop holder bar to wind the respective woof thread around a hooking portion of the curling hook.

Subsequently, the cop translates away from the curling hook to place itself in correspondence with the first position.

When the cop again reaches the first position, the curling hook rotates by a predetermined number of turns around an axis perpendicular to the hooking portion, causing the respective woof thread to curl. In this phase the curling hook translates along its own axis of rotation to facilitate the consequent shortening of the woof thread which is about to be curled.

Once the woof thread is curled, disengagement means act directly on the thread itself to disengage it from the curling hook, extracting it from the hooking position.

The woof thread is curled synchronously with the motion of the thread-passers and of the needles, thereby obtaining a thread that is enmeshed in the chain points and curled on itself in the portion projecting laterally from the chain.

One problem present on such crochet machines is given by the fact that it is possible to produce solely festoons having twisted threads of the same length.

In fact, such machines do not meet current market demands which require also the production of festoons with twisted threads whose lengths are respectively differentiated according to a pre-defined sequence.

Currently, the only possibility for intervention provided by the state of the art consists of setting the machine to produce festoons with twisted threads of a desired length which, however, is always the same for all the twisted threads of the festoon. The operations to be performed for the purposes of the aforementioned setting are, on the other hand, quite long and complicated.

SUMMARY OF THE INVENTION

The object of the present invention is to solve the problems present in the prior art proposing a device able to be applied on a crochet machine for warp weaving which allows, in the production of each festoon, the possibility of modifying the length of the twisted threads of the festoon itself in an extremely simple and immediate way.

This object and others besides, which shall become more readily apparent in the course of the present description, are essentially attained by a device for obtaining festoons on a crochet machine for warp weaving, wherein the improvement comprises: at least one hook holder block engaging the curling hook; second control means operating on the hook holder block to take the curling hook between a starting position, wherein the curling hook is located in correspondence with the thread-guiding cop, and an ending position, wherein the curling hook is located between the starting position and the needles; selection means operatively associated to the second control means to select the distance of the starting position and of the ending position of the needles at each working cycle of the weaving machine.

In accordance with the present invention, a method has also been devised for obtaining festoons on a crochet machine for warp weaving, wherein the improvement comprises the phase of selecting the distance of said starting position and of said ending position with respect to the needles at each working cycle to determine the formation of twisted threads with differentiated lengths.

Additional features and advantages shall be more readily apparent from the detailed description of a preferred, but not exclusive, embodiment of a device for obtaining festoons on a crochet machine for warp weaving, in accordance with the present invention. The description shall be made hereafter in reference to the accompanying drawings, provided purely by way of non limiting example.

DESCRIPTION OF THE PREFERRED EMBODIMENT

Figure 1:
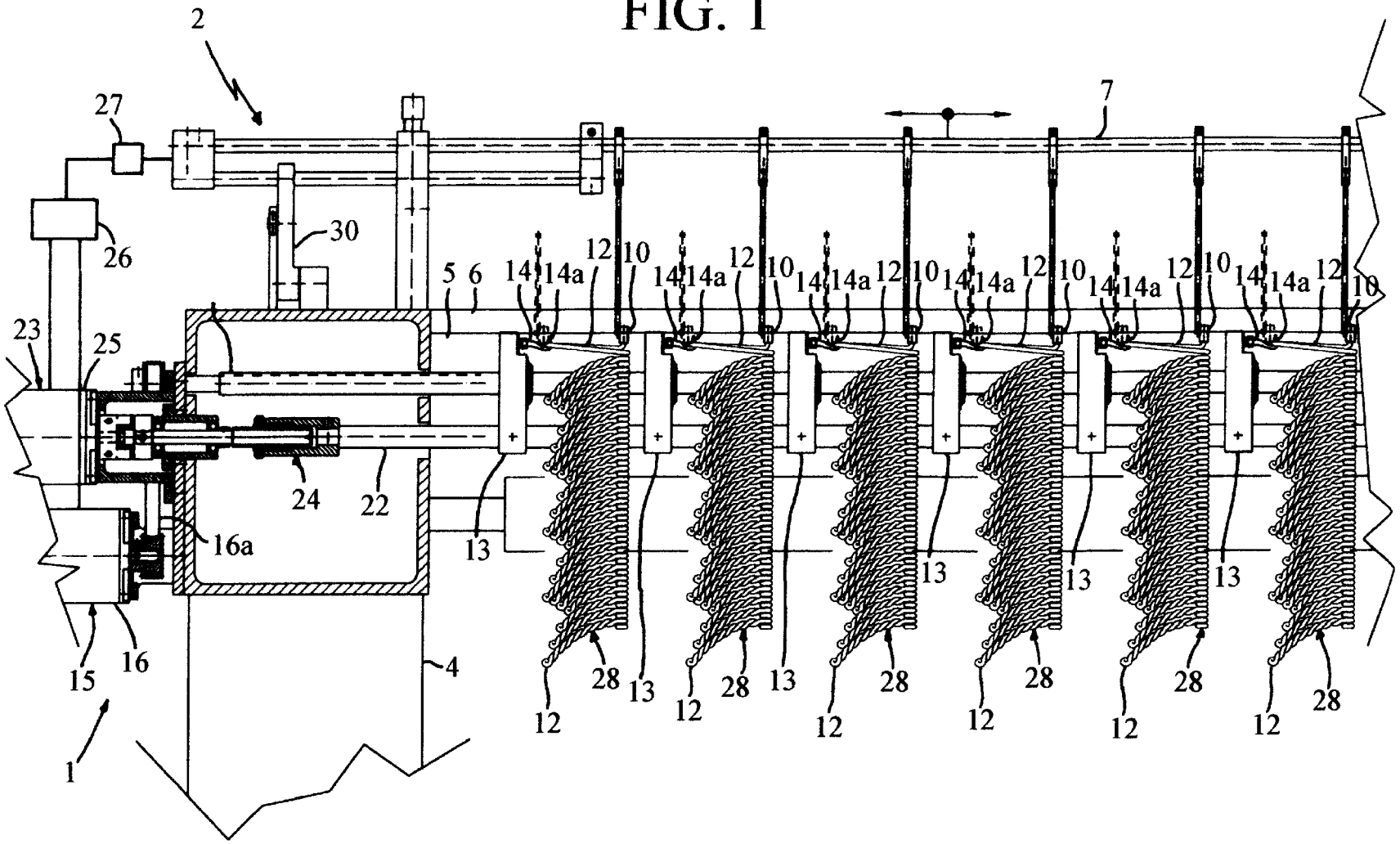
FIG. 1 shows an interrupted front view, partially sectioned, of a crochet machine provided with a device, according to the present invention.
Figure 2:
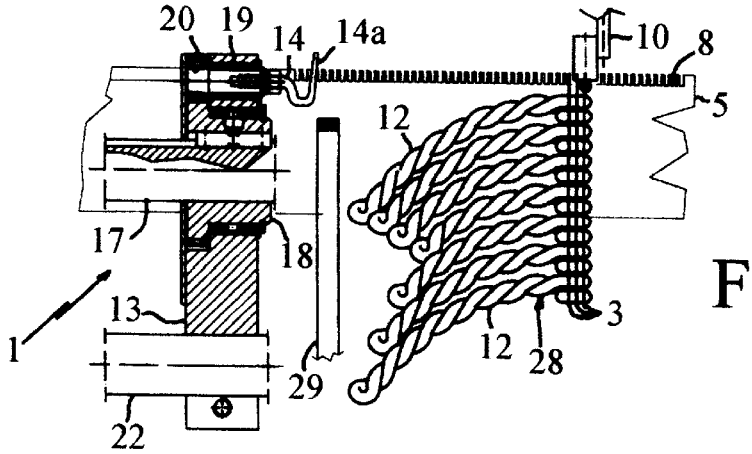
FIG. 2 shows the device with the hook in a starting position and the cop in a first operative position.

With reference to the aforementioned drawings, the number 1 indicates in its entirety a device for obtaining festoons on a crochet machine 2 for warp weaving.

Overall the machine 2 comprises a foundation wherefrom extend vertically two lateral uprights 4 (only one whereof is visible in the drawings) serving as supports to a front bar 5, to a movable front bar 6, to a cop-holder bar 7 and to a thread-passer holder bar (not shown in the figures). The bars are interposed between the two uprights and are set parallel to each other.

Figure 3:
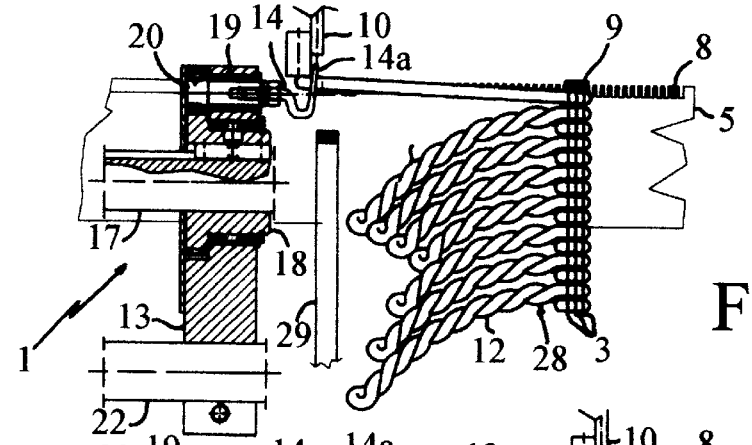
FIG. 3 shows the device with the hook in the starting position and the cop in a second position in correspondence with the hook.
Figure 4:
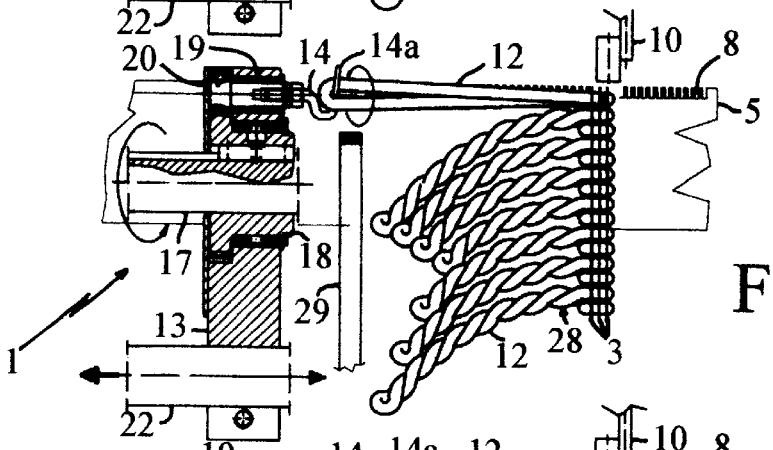
FIG. 4 shows the device in an operative phase wherein the hook is rotating and the cop is located in the first position.
Figure 5:
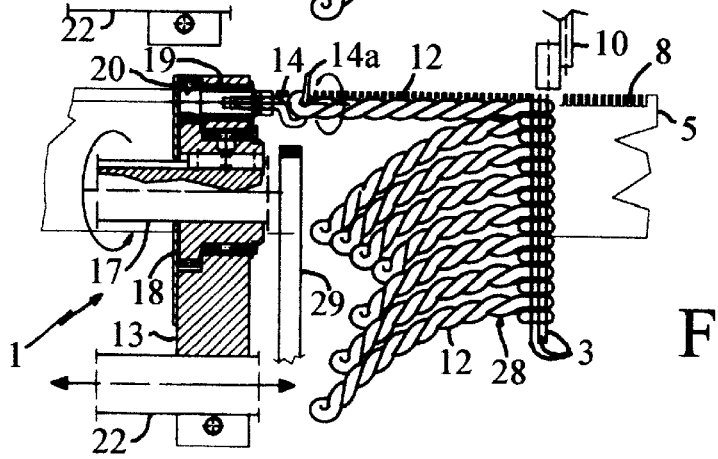
FIG. 5 shows the device with the hook in an ending position and the cop in the first position.

The front bar 5 presents a plurality of grooves 8 set side by side and positioned perpendicularly to the bar itself to receive in operative engagement respective needles 9 (FIG. 3) fastened to the movable front bar 6. In a way known in itself, the needles 9 cooperate with respective thread-passers mounted on the aforesaid thread-passer holder bar and engaging respective warp threads. The co-operation between the needles 9 and the thread-passers gives rise to at least one support ribbon formed by a plurality of parallel chains 3 which progressively descend from the front bar 5.

The cop-holder bar 7 presents a plurality of thread-guiding cops 10 set parallel to each other and co-operating with the needles 9 to enmesh respective woof threads 12 in the chains 3.

For this purpose, the cop-holder bar 7 is conventionally actuated with a vertical oscillatory motion synchronized with an alternating horizontal motion along its own longitudinal development, to make each thread-guiding cop 10 complete a trajectory extending astride a respective group of needles 9.

More specifically, the horizontal motion of the cop-holder bar 7 takes each thread-guiding cop 10 between a first position wherein it is located in proximity to the respective group of needles 9 and a second position wherein the cop itself is laterally displaced with respect to the needles 9 to extend the woof thread 12 away therefrom.

The device 1 comprises a plurality of hook-holder blocks 13 operatively engaging respective curling hooks 14 which are subjected to the action of the first control means 15, to be rotatorily actuated each around its axis of rotation essentially perpendicular to a respective hooking position 14*a* of the hook itself.

The first control means 19 comprise a first stepping motor 16 rotatorily engaged, for instance through a positive drive belt 16*a*, to a grooved shaft 17 which in turn engages in integral rotation gear wheels 18 present each on one of the hook holder blocks 13.

Each gear wheel 18 is connected to a tang 19 through a pinion 20 splined onto an end of the tang itself. On the other end of the tang 19 is rigidly engaged the respective curling hook 14.

When the first stepping motor 16 is activated, the grooved shaft 17 rotates together with the gear wheels 18, which actuate the rotation of the pinions 20 and consequently the tangs 19 with the respective curling hooks 14.

The hook-holder blocks 13 are rigidly engaged to a transmission bar 22 which extends parallel to a direction of alignment of the needles 9 on the front bar 5 and it is operatively connected to second control means 23 by means of a screw—nut screw coupling 24. The second control means 23 are able to take the curling hooks 14 between a starting position wherein each curling hook 14 is moved away from the respective group of needles 9 and positioned in correspondence with the respective thread-guiding cop 10 in said second position, and an ending position wherein the curling hook 14 is located between the starting position and the needles 9. The second control means 23 comprise a second stepping motor 25 which transmits a translating motion to the transmission bar 22 through the screw—nut screw coupling 24.

The device 1 further comprises selection means 26 operatively associated to the first motor 16 and to the second motor 25 respectively to select the number of turns to be completed by the second curling hook 14 according to the distance from the needles reached by the curling hook in the starting position and in the ending position.

The selection means 26 preferably comprise a programmable electronic regulating unit containing a software to control both the motors 16, 25, and one or more possible third stepping motors 27 destined to transmit the horizontal alternating motion of the cop-holder bar 7, synchronizing the first position and the second position of the thread-guiding cops 10 according to the starting position assumed by the curling hooks 14.

Before starting the production of the festoons 28 the operator enters into the regulating unit 26 the data pertaining to the work process to be performed to control the motors 16, 25 and 27 in relation to a desired operative sequence, defined by a series of work cycles entailing each the formation of a single twisted woof thread 12.

Once the data have been entered and the manufacture of the festoons 28 has been started, the regulating unit 26 controls the individual stepping motors 16, 25 and 27 to perform the first work cycle according to such data, initially activating the second motor 25 by a pre-determined number of steps to take each curling hook 14 to the pre-set starting position. During the execution of the operating cycle, the regulating unit 26 commands the activation of the third motor 27, to take each thread-guiding cop 10 into the second position in proximity to the curling hook 14.

When each thread-guiding cop 10 arrives in proximity to the respective curling hook 14, the regulating unit 26 activates the first motor 16 to make the hook 14 perform a slight angular rotation, so that the woof thread 12 borne by the cop 10 is wound around the hooking portion 14*a* of the curling hook itself. Such winding of the woof thread 12 around a hooking portion 14*a* can also be obtained upon the action of mechanical or pneumatic control means 30, which transmit to the cop-holder bar 7 an angular rotation around an axis parallel to its longitudinal development. In this way, each of the thread-guiding cops 10 performs a slight angular rotation around the axis of longitudinal development of the bar itself, thereby causing the woof thread 12 to be wound around the hooking portion 14*a*.

The regulating unit 26 then actuates the cop-holder bar 7 by means of the third motor 27 to take each cop 10 to the first position.

Subsequently the regulating unit 26 activates the first stepping unit 16 to obtain a curling of the woof thread 12 through the rotation of the curling hook 14 according to a number of turns pre-defined depending on the desired spiraling pitch. Simultaneously to the activation of the first motor 16, the second motor 25 is activated to take the curling hook 14 to the ending position.

The distance of the hook 14 from the needles 9 in the ending position is determined according to the extent to which the woof thread 12 has been shortened as a result of the curling.

Once the woof thread 12 is curled, it is disengaged from the curling hook 14. Such disengagement action can be obtained for instance by means of a thruster element 29 which can be actuated mechanically, in any way known in itself, to thrust the twisted thread 12 upward until it moves beyond the hooking portion 14*a*. Alternatively, according to the invention, the disengagement can be obtained by activating the first motor 16 to transmit to each hook 14 an angular rotation such as to orient the hooking portion in the direction opposite to the needles 9.

In this situation the twisted thread descends by gravity, extracting itself from the hooking portion 14*a*.

At the beginning of the new work cycle, the regulating unit 26 selects, according to the programmed operating sequence, a new starting position of the curling hook 14 and all the other functional parameters pertaining to the activation of the stepping motors 16, 25 and 27 to form a new twisted thread 12 with different length from that of the twisted thread formed previously.

It should be observed that by changing the distances of the starting and ending positions, and the number of turns completed by the hook 14 at each work cycle, the regulating unit 26 causes woof threads of different lengths to curl whilst maintaining their spiraling pitch constant.

Once all work cycles in the operating sequence have been completed, the final result obtained is a festoon having twisted threads with different lengths and constant spiraling pitch.

The present invention attains the proposed aims.

The subject device allows any crochet machine for warp weaving to produce both festoons comprising twisted threads of constant length and festoons having twisted threads with different lengths.

With this device, the problem of slowing production down in order to stop the machines to adjust the starting and ending positions of the curling hooks does not arise even minimally, since the regulating unit 26 can be programmed in a simple and immediate way, for instance loading an operating sequence stored on magnetic or optical support.

Such a device allows crochet machines for the manufacture of festoons to meet market demands by producing festoons having twisted threads with different lengths for textile ornaments and/or embellishments.

What is claimed:

1. Device for obtaining festoons on a crochet machine for warp weaving, said machine comprising one or more needles, at least one thread-guiding cop movable between a first position wherein the thread-guiding cop is located in proximity to the needles to engage operatively therewith at least one woof thread borne by the cop itself, and a second position wherein the cop is laterally displaced with respect to the needles to extend the woof thread away therefrom, said device comprising:

at least one curling hook presenting a hooking portion set to engage the woof thread borne by the thread-guiding cop;

first control means to actuate the rotation of the curling hook around an axis of rotation essentially perpendicular to the hooking portion itself;

wherein the improvement comprises:

at least one hook-holder block engaging the curling hook;

second control means operating on the hook-holder block to take the curling hook from a starting position, wherein the curling hook is located in correspondence with the thread-guiding cop, and an ending position, wherein the curling hook is located between the starting position and the needles;

selection means operatively associated to the second control means to select the distance of the starting position and of the ending position from the needles at each working cycle of the textile machine.

2. Device according to claim 1, wherein said selection means also manage the first control means to select the number of rotations of the curling hook around the axis of rotation according to the distance assumed by the curling hook from the needles in the starting position and in the ending position.

3. Device according to claim 1, wherein said selection means are connected to a cop-holder bar to control the second position of the thread-guiding cop according to the distance from the needles assumed by the curling hook in the starting position.

4. Device according to claim 3, further comprising auxiliary control means to actuate the cop-holder bar according to an angular rotation around an axis parallel to its longitudinal development.

5. Device according to claim 1, wherein said selection means comprise at least one programmable electronic regulating unit.

6. Device according to claim 1, wherein said first and second control means comprise respectively at least a first and at least a second stepping motor.

7. Device according to claim 1, further comprising at least one transmission bar which develops parallel to a direction of alignment of the needles and is actuated by the second control means through a screw-nut screw coupling.

8. Device according to claim 6, wherein said transmission bar is adapted to be operatively engaged to a plurality of hook-holder blocks.

9. Device according to claim 1, wherein said first control means comprise:

at least one gear wheel rotatorily housed in the hook-holder block and engaged in rotation by a grooved shaft, adapted to be actuated in rotation;

at least one pinion connected to a tang bearing the curling hook, said pinion being adapted to be actuated in rotation by means of the gear wheel.

10. Method to obtain festoons on a crochet machine for warp weaving, comprising the phases of:

moving at least one thread-guiding cop from a first position wherein the thread-guiding cop is located in proximity to one or more needles to engage operatively therewith at least one woof thread borne by the cop itself, to a second position wherein the cop is laterally displaced with respect to the needles to extend the woof thread;

winding the woof thread around a hooking portion of a curling hook located in correspondence with the second position of the thread-guiding cop by causing the cop to pass around the hooking portion and bringing said cop back to the first position;

rotating the curling hook around an axis of rotation perpendicular to said hooking portion to curl the wound woof thread and form a twisted thread of predetermined length;

translating the rotating curling hook from a starting position, wherein the curling hook is located in correspondence with the thread-guiding cop in the second position, to an ending position, wherein the curling hook is located between the starting position and the needles;

disengaging the twisted thread from the curling hook;

wherein the improvement comprises the phase of selecting the distance of said starting position and of said ending position with respect to the needles at each working cycle to determine the formation of twisted threads of differentiated lengths.

11. Method according to claim 10, wherein at each working cycle the further phase is completed of selecting the distance of the second position of the thread-guiding cop from the first position according to the distance from the needles of the starting position selected in the same working cycle.

12. Method according to claim 10, further comprising a phase of oscillating the curling hook around said axis of rotation to complete said phase of winding the woof thread around the hooking portion.

13. Method according to claim 10, further comprising a phase of rotating angularly the thread-guiding cop to perform said phase of winding the woof thread around the hooking portion.

14. Method according to claim 11, wherein the phase of disengaging the twisted thread is performed through the angular rotation of the curling hook to orient said hooking portion in a direction opposite to the needles.

* * * * *